US008308452B2

(12) United States Patent
Amirouche et al.

(10) Patent No.: US 8,308,452 B2
(45) Date of Patent: Nov. 13, 2012

(54) DUAL CHAMBER VALVELESS MEMS MICROPUMP

(75) Inventors: Farid Amirouche, Highland Park, IL (US); Enrico Zordan, Soave (IT)

(73) Assignee: The Board of Trustees of the University of Illinois, Urbana, IL (US)

( * ) Notice: Subject to any disclaimer, the term of this patent is extended or adjusted under 35 U.S.C. 154(b) by 456 days.

(21) Appl. No.: 11/991,765

(22) PCT Filed: Sep. 11, 2006

(86) PCT No.: PCT/US2006/035142

§ 371 (c)(1),
(2), (4) Date: Jun. 12, 2009

(87) PCT Pub. No.: WO2007/030750

PCT Pub. Date: Mar. 15, 2007

(65) Prior Publication Data

US 2009/0297372 A1 Dec. 3, 2009

Related U.S. Application Data

(60) Provisional application No. 60/716,014, filed on Sep. 9, 2005.

(51) Int. Cl.
*F04B 17/03* (2006.01)

(52) U.S. Cl. ..... 417/413.2

(58) Field of Classification Search ..... 417/413.2, 417/413.1, 395; 92/96, 98 R
See application file for complete search history.

(56) References Cited

U.S. PATENT DOCUMENTS

| | | | | |
|---|---|---|---|---|
| 3,141,605 | A * | 7/1964 | Asamaki | 417/49 |
| 4,240,002 | A * | 12/1980 | Tosi et al. | 310/324 |
| 4,496,294 | A | 1/1985 | Frikker | |
| 4,939,405 | A * | 7/1990 | Okuyama et al. | 310/330 |
| 6,164,933 | A | 12/2000 | Tani et al. | |
| 6,203,291 | B1 * | 3/2001 | Stemme et al. | 417/413.3 |
| 7,219,848 | B2 * | 5/2007 | Sweeton | 239/102.2 |
| 7,431,574 | B2 * | 10/2008 | Onishi | 417/413.2 |
| 2005/0089415 | A1 | 4/2005 | Cho et al. | |

FOREIGN PATENT DOCUMENTS

| | | |
|---|---|---|
| DE | 101 64 474 A1 | 7/2003 |
| DE | 103 13 158 A1 | 10/2004 |

OTHER PUBLICATIONS

EPO-TEX® H31—Technical Data Sheet dated Apr. 2010.
Corning Pyrex® 7740—Properties; available at least as early as Apr. 12, 2012.

* cited by examiner

*Primary Examiner* — Devon Kramer
*Assistant Examiner* — Bryan Lettman
(74) *Attorney, Agent, or Firm* — Marshall, Gerstein & Borun LLP

(57) ABSTRACT

A valveless MEMS micropump capable of improved efficiency and performance is disclosed. The micropump includes two adjoining chambers separated by a piezoelectric actuated pump membrane. The micropump moves fluid through the chambers through diffuser elements characterized by differential directional resistance to fluid flow by piezoelectric actuation of the pump membrane.

19 Claims, 8 Drawing Sheets

*Fig. 8a* *Fig. 8b* *Fig. 8c*
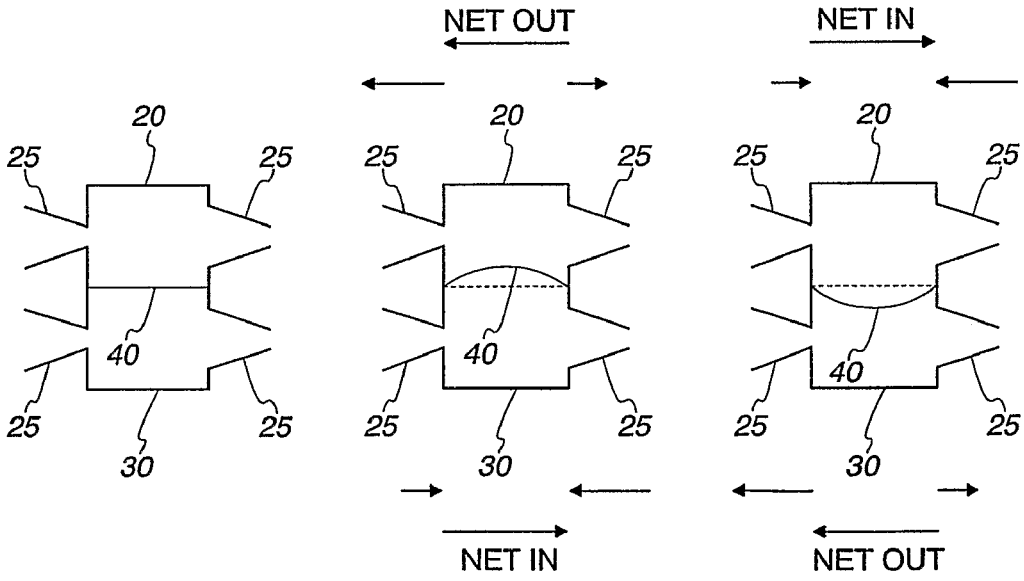

DUAL CHAMBER VALVELESS MEMS MICROPUMP

This application is the National Stage of PCT/US2006/035142, filed on Sep. 11, 2006, which claims the benefit of U.S. Provisional Application Ser. No. 60/716,014, filed on Sep. 9, 2005, each of which is incorporated herein by reference in its entirety.

TECHNICAL FIELD OF THE INVENTION

The present invention relates generally to micro-electro-mechanical systems (MEMS) devices, specifically MEMS microfluidic pumps.

BACKGROUND OF THE INVENTION

Micro-electro-mechanical systems (MEMS) involve the fabrication of small mechanical devices integrating sensors, actuators, mechanical elements and electronics on a silicon substrate at the micrometer scale. MEMS devices are manufactured through micromachining processes such as deposition, lithography and etching and are frequently used in the biomedical and electronics industries.

MEMS micropumps are designed to handle small amounts of liquids, on the order of several microliters to several milliliters per minute. These microfluidic devices are used in a number of technologies, including inkjet printers and particularly in the biomedical arts such as in electrophoresis systems, microdosage drug delivery systems, biosensors and automated lab-on-a-chip applications. MEMS micropumps remain a promising area of medical care technology.

MEMS micropumps can be generally classified into two groups: mechanical pumps with moving parts and non-mechanical pumps with no moving parts. Mechanical micropumps can be further differentiated by the mechanism in which they operate, including peristaltic, reciprocating and rotary pumps. These pumps are operated using a variety of actuation mechanisms such as pneumatic, thermopneumatic, electrostatic and piezoelectric principles.

In order to maximize pump efficiency, some micropumps employ the use of check valves. These check valves permit forward fluid flow during the drive cycle of the pump while minimizing or preventing reverse flow of the fluid during the priming cycle. Examples of this type of design are given in U.S. Pat. No. 6,179,856 and U.S. published patent application number 2005/0089415. Another piezoelectric actuation of a valved pump is described in U.S. Pat. No. 5,215,446. The inlet and outlet arrangements of this pump do not operate completely independently, limiting the pump to applications where complete isolation of the inlet and the outlet circuits is required.

Pumps requiring valves suffer from a number of drawbacks. Wear and fatigue cause a drop in performance and reliability. Check valves can also introduce a significant pressure loss that reduces pump performance when used to pump viscous working fluids. If particle-laden working fluids are involved, such as blood, there is a risk of the suspended particles clogging the valve.

In order to avoid these drawbacks, a variety of different valveless pump arrangements can be used. For example, U.S. Pat. No. 4,648,807 discloses a compact piezoelectric fluidic air supply pump. Using piezoelectric actuation, this double chamber pump vibrates a diaphragm to deliver an air supply. The pump is elongated in a direction parallel to the plane of the diaphragm. Inlet and outlet passageways are also elongated in this same direction, thus limiting the pump to a limited number of air supply applications, while compromising pump efficiency.

U.S. Pat. No. 6,203,291 discloses a displacement pump in which a diaphragm extends across perpendicularly oriented flow-constricting inlet and outlet chambers. The pump utilizes a single, rounded pumping chamber. U.S. Pat. Nos. 6,227,809, 6,910,869 and 5,876,187 also disclose pumps with a single circular pumping chamber, which limits the pump to those applications having less demanding requirements for a given allocation space.

Another type of valveless pump is disclosed in U.S. Pat. No. 6,179,584. The pump is configured in a silicon chip and a piezoelectric actuation drives one side of a single silicon membrane, thus limiting the pump to applications where lesser drive levels are needed.

U.S. Pat. No. 6,729,856 discloses an electrostatic pump with elastic restoring forces, and is operated so that fluids are passed through the pump while avoiding the electric field of the electrostatic actuator. Only a single pumping chamber of hemispherical shape is employed, and while being capable of operation in a valveless mode, practical valve operations may require the pump to meet greater throughput requirements.

U.S. published patent application 2006/0083639 discloses a micropump of PDMS material utilizing lead-in and lead-out nozzle structures connected to a single pumping chamber. The pump membrane is driven by a piezoelectric actuator, with a single piezoelectric disk located on one side of a membrane. This is an example of a valveless pump which includes a control element comprising a nozzle, instead of a valve. The control element can also comprise a diffuser element in place of the valve. In certain applications, nozzles and diffusers may be constructed according to different design principles, although for purposes of the present invention, the two are generally interchangeable.

One important feature of the control element is that its internal passageway changes in cross-sectional size as the length of the control element is traversed. Preferably, the change in cross-sectional size is continuous, and the direction of change is constant, although cylindrical sections could be introduced in some instances. That is, it is generally preferred that the control element is either outwardly flared or inwardly flared, and may have a frusto-pyramidal or frusto-conical shape, for example.

The control element, operates by providing a flow channel with a gradually expanding cross-section so that differential flow resistance is different in the forward and reverse flow directions. However, limitations are encountered in the above-mentioned micropump, since only a single pumping chamber is provided, with a diaphragm actuated on only one side by a single piezoelectric disk. Also, the inlet and outlet nozzle structures are oriented perpendicular to the plane of the diaphragm, limiting the pump to a number of specialized applications, and hampering efficiency.

The efficiency of known piezoelectric valveless micropumps is governed by fluid leakage losses (volumetric efficiency), frictional losses (mechanical efficiency) and imperfect pump construction (hydraulic efficiency). In addition to poor performance, inefficient pumps require a larger power source to drive the piezoelectric actuation mechanism, increasing costs and size. Thus, there is a need for an optimized piezoelectric valveless micropump with improved efficiency and reliability.

SUMMARY OF THE INVENTION

The present invention relates to a dual chamber valveless MEMS micropump. In one embodiment, the micropump utilizes a double superimposed chamber, with one chamber located above the other, wherein the upper and lower chambers share a common pump membrane. Each chamber includes at least two diffuser elements for fluid entry and exit. If desired, the micropump could also be operated in different orientations, such as with the chambers oriented in a horizontal direction, that is, located alongside one another.

In a preferred embodiment, the pump membrane is a multilayer piezoactuated membrane. In view of the need to insulate electrical components from the fluid, a layered, stacked or "sandwich" configuration is preferred. In one embodiment, a layer of piezoelectric material is held between two layers of conducting material such as a conductive epoxy, to form a piezoelectric disc. A passive plate of inert material, such as PYREX® material, is layered between the two piezoelectric discs. If desired, a flexible inert material could be used as an alternative. The entire membrane structure is further bound between two layers of silicon rubber. If desired, multiple layers of piezoelectric material can be employed, to increase pumping force. For example, the membrane could be located between two piezoelectric layers acting in concert to drive the membrane with greater force.

The present invention provides a novel and improved valveless micro-electro-mechanical micropump that minimizes the disadvantages associated with prior art pump equipment. One embodiment of the valveless micro-electro-mechanical micropump comprises a plurality of chambers, with a deformable pump membrane separating the plurality of chambers. Each chamber has a plurality of diffuser elements providing a fluid connection between the interior of the chamber and the exterior of the chamber. Each of the diffuser elements is further characterized by two openings of differing cross-sections and at least a portion of the diffuser element between the two openings being tapered. The pump membrane may be comprised of piezoelectric materials so as to be deformable by piezoelectric forces. In one example, the pump membrane is comprised of two insulated piezoelectric discs.

The diffuser elements may, in one example, have a flat-walled configuration and a substantially rectangular cross section. In another example, the diffuser elements are frusto-pyramidal in shape.

In another embodiment, a valveless micro-electro-mechanical micropump comprises an enclosure defining an interior chamber which is separated into an upper chamber and a lower chamber by a piezoelectrically responsive membrane. The upper chamber and the lower chamber each have an inlet opening and an outlet opening for providing fluid communication between the exterior of the enclosure and the chamber. The inlet opening has a chamber end and an exterior end, with the cross-section of the chamber end being larger than the cross-section of the exterior end. The outlet opening further has a chamber end and an exterior end, with the cross-section of the exterior end being larger than the cross-section of the chamber end. Accordingly, when the piezoelectrically responsive membrane is deflected, fluid is pumped through the inlet opening into the chamber and out the outlet opening.

In one example, the piezoelectrically responsive membrane comprises an intermediate layer between two piezoelectric discs. If desired, the piezoelectric discs may be insulated by a gasket. The gasket may be comprised of a suitable material, such as silicon rubber.

The inlet openings and the outlet openings preferably are operated as a nozzle or diffuser element. In one example, the inlet and the outlet openings have a generally frusto-conical shape. In another example, the inlet and the outlet openings have a generally frusto-pyramidal shape.

BRIEF DESCRIPTION OF THE DRAWINGS

In the drawings,

FIG. 8 is a schematic showing the operation of the micropump.

DETAILED DESCRIPTION OF THE PREFERRED EMBODIMENTS

Figure 1:
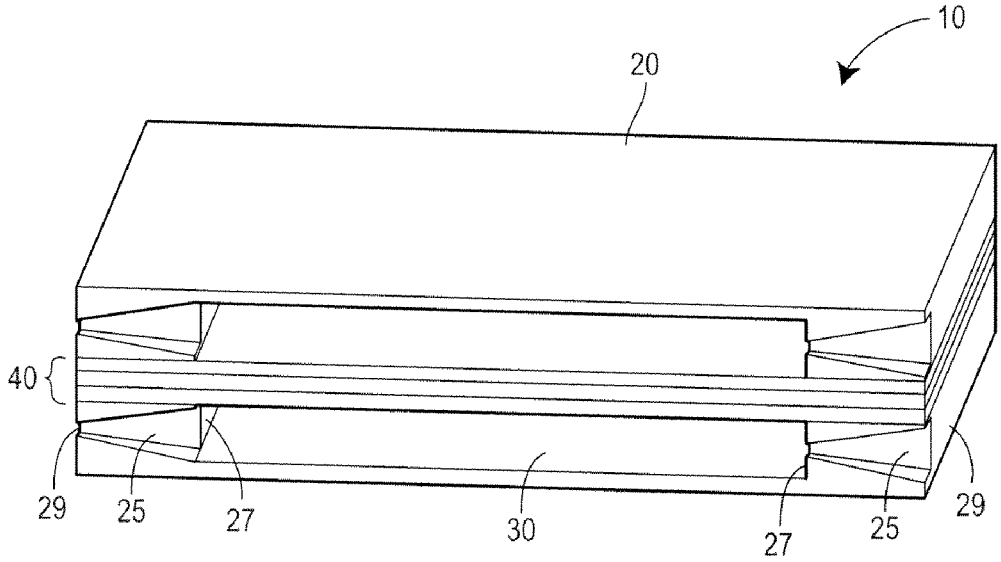
FIG. 1 is a perspective view of a section of one preferred embodiment of the present invention embodied in a double superimposed chamber valveless MEMS micropump.

The invention disclosed herein is, of course, susceptible of embodiment in many different forms. Shown in the drawings and described herein below in detail are preferred embodiments of the invention. It is understood, however, that the present disclosure is an exemplification of the principles of the invention and does not limit the invention to the illustrated embodiments.

For ease of description, a micropump apparatus is described herein in its usual assembled position as shown in the accompanying drawings, and terms such as upper, lower, horizontal, longitudinal, etc., may be used herein with reference to this usual position. However, the micropump apparatus may be manufactured, transported, sold, or used in orientations other than that described and shown herein.

As will be seen herein, actuation of a membrane is preferably provided with piezoelectric discs. Due to the preferred layout of the pump components, and the desire to meet the most demanding application requirements, it was found desirable to insulate virtually every electrical component from contact with the working fluid being passed through the pump. For this reason, a "sandwich" structure was chosen for the membrane. As will be seen herein, in one embodiment, the membrane is composed of as many as nine different layers. However, due to the manufacturing efficiencies which are now available in the production of MEMS systems, the cost of membrane construction can be very reasonable. It will be appreciated that design requirements will be lessened in some applications. For example, insulation of the membrane components carrying electrical current may be substantially reduced, compared to the preferred constructions described herein.

Figure 2:
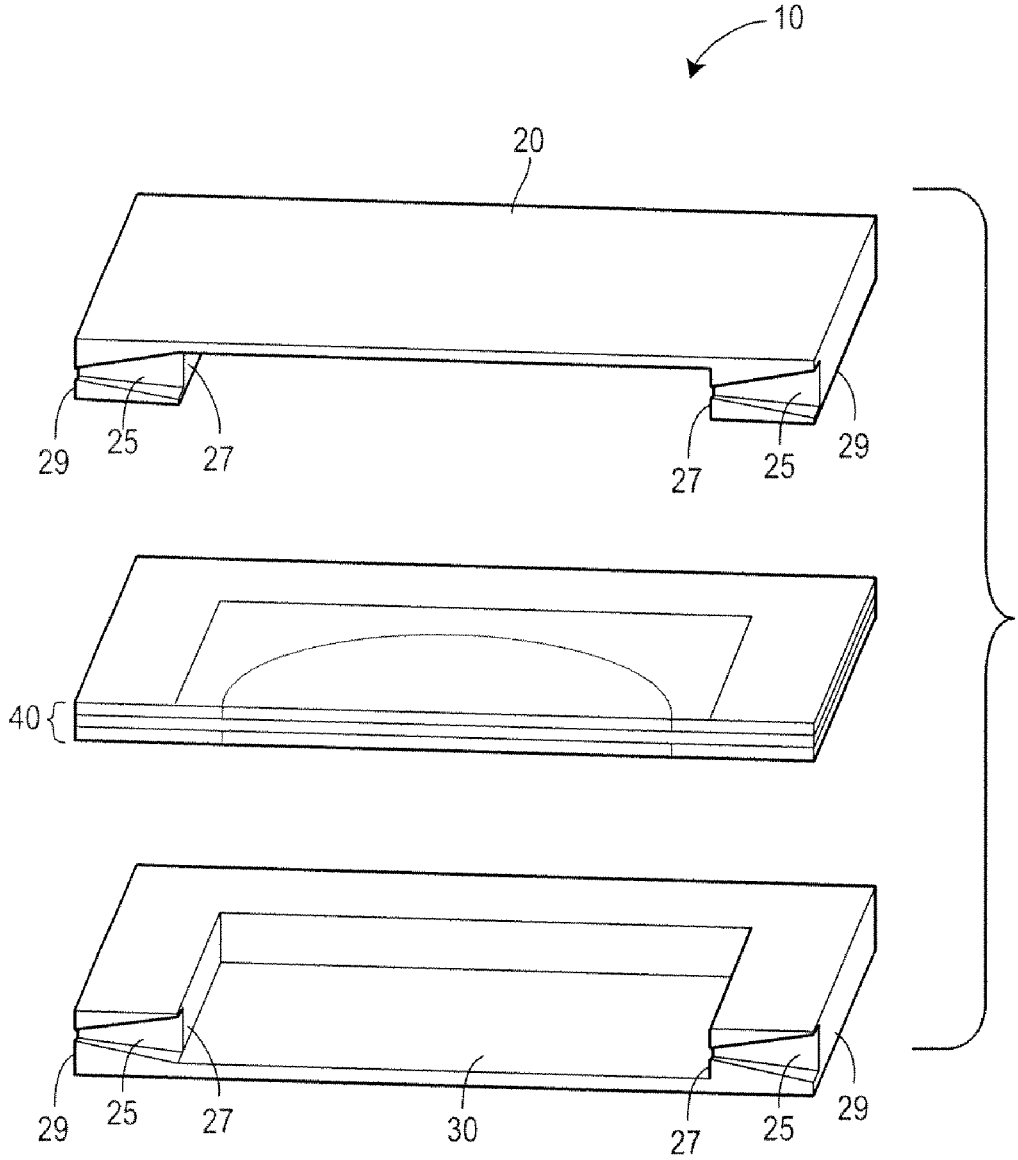
FIG. 2 is an exploded view of the micropump of FIG. 1 showing the two chambers and the pump actuation membrane.

Referring now to the drawings, FIGS. 1 and 2 show a preferred embodiment of a micropump 10 according to principles of the present invention. The micropump 10 includes two chambers, an upper chamber 20 and a lower chamber 30, separated by a common pump membrane 40. Each chamber has at least two diffuser elements 25 for permitting fluid flow into and out of each chamber. The diffuser elements 25 each have a chamber end 27 opening to the interior of upper chamber 20 or lower chamber 30 and an exterior end 29 opening out of the micropump 10.

The chambers preferably have identical dimensions with a simple geometry. Preferably the chambers are made of a single wafer of silicon to provide additional structural stiffness and eliminate the need for junctions. The chambers can be machined using a variety of physical and chemical etching techniques such as wet etching, dry etching, or deep reactive ion etching.

Figure 3:
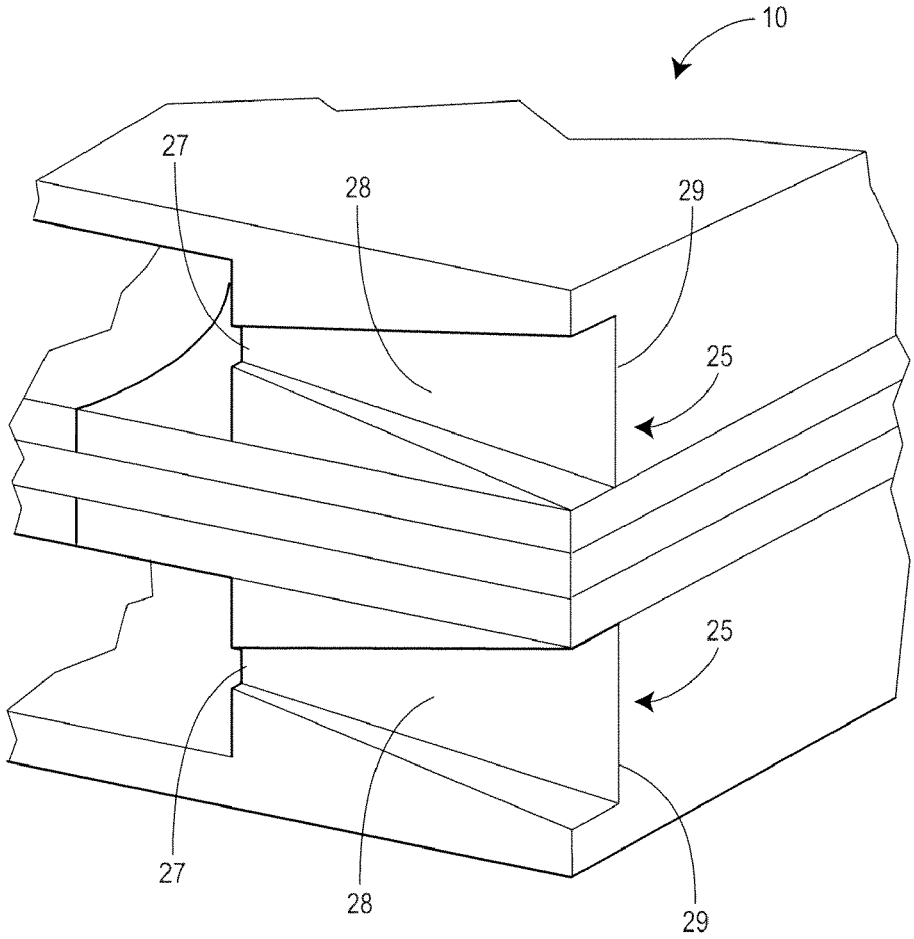
FIG. 3 is an enlarged view of the diffuser elements in the preferred embodiment.

FIG. 3 is an enlarged view of the diffuser elements 25 in a preferred embodiment. Each diffuser element 25 provides a path for fluid communication between the exterior of the micropump 10 and the interior of either the upper chamber 20 or a lower chamber 30. The diffuser elements 25 include a chamber end opening 27 and a exterior end opening 29 with a fluid channel 28 therethrough. In a diffuser element 25, the cross-sectional area of the chamber end 27 and the cross-sectional area of the exterior end 29 are different. Ideally, at least a portion of each diffuser element 25 is gradually tapered from one opening to the other. It should be noted that the chamber end opening 27 is not necessarily always smaller or larger than the exterior end 29 opening.

Figure 4:
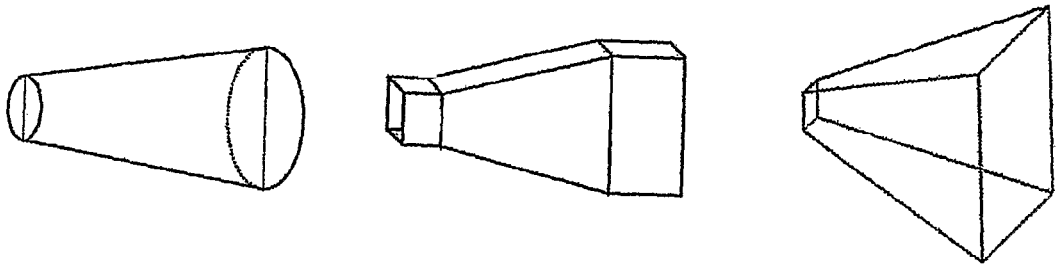
FIG. 4 shows several examples of diffuser element geometries.

A variety of geometries can be employed for the diffuser element 25. Several examples of such geometries, specifically a conical diffuser and two types of flat walled diffusers, are shown in FIG. 4. While a conical geometry is acceptable, flat walled diffusers are preferred since they provide better performance in a more compact design. Preferably, a four-sided frusto-pyramidal diffuser element is used for ease of manufacturing and enhanced performance. It should be understood that geometries other than those shown in FIG. 3 may be used for the diffuser elements 25. If desired, curved wall sections may also be used for the diffuser, although this has not been found to be necessary.

The choice of diffuser geometry may also be dependent on the fabrication process used. The dimensions of the diffuser elements depend on the properties of the fluid to be pumped and on the desired optimum working frequency and force of which the fluid is to be pumped. Preferably, the precise geometry of the diffuser element 25 is optimized for the fluid the micropump 10 is designed to handle.

The flexible membrane 40 is a layered composite of a number of materials forming a common partition separating the upper chamber 20 and the lower chamber 30. In addition, the membrane 40 acts as a diaphragm under the appropriate stimuli, flexing to increase or decrease the volume within the upper chamber 20 and the lower chamber 30. The membrane is designed to minimize stress concentration points in order to permit operation under high stress and at high frequency. Layers can be permanently joined using wafer bonding techniques such as fusion bonding, anodic bonding, and eutectic bonding.

Figure 5:
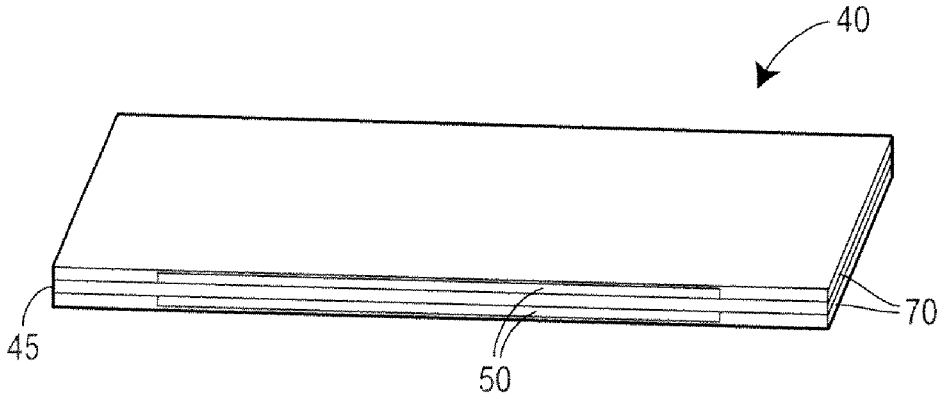
FIG. 5 shows the layers of the pump membrane.
Figure 6:
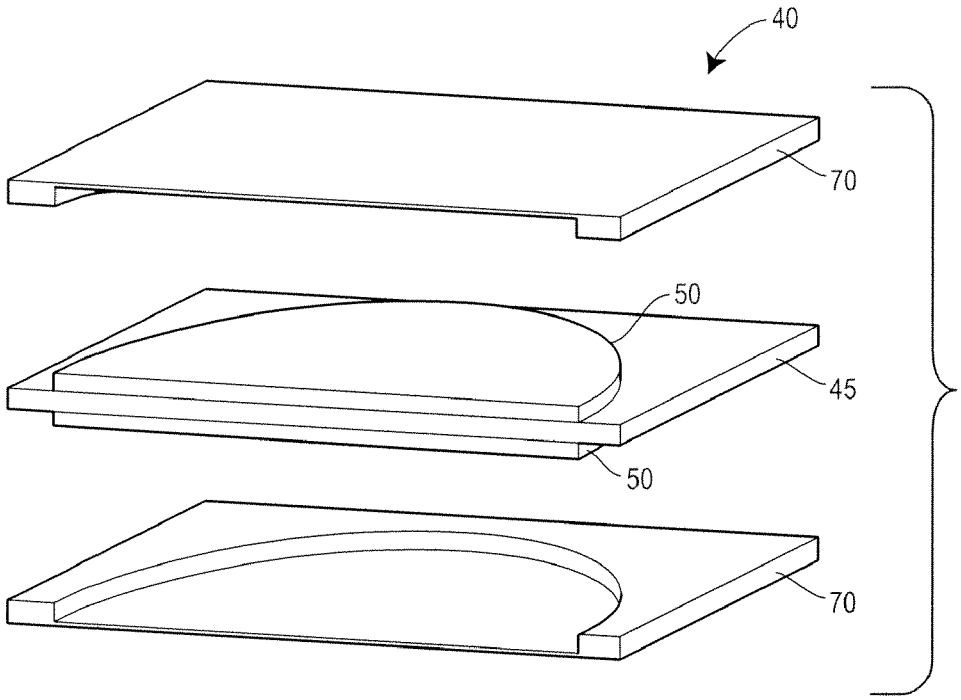
FIG. 6 is a partially exploded view of the pump membrane of FIG. 5.
Figure 7:
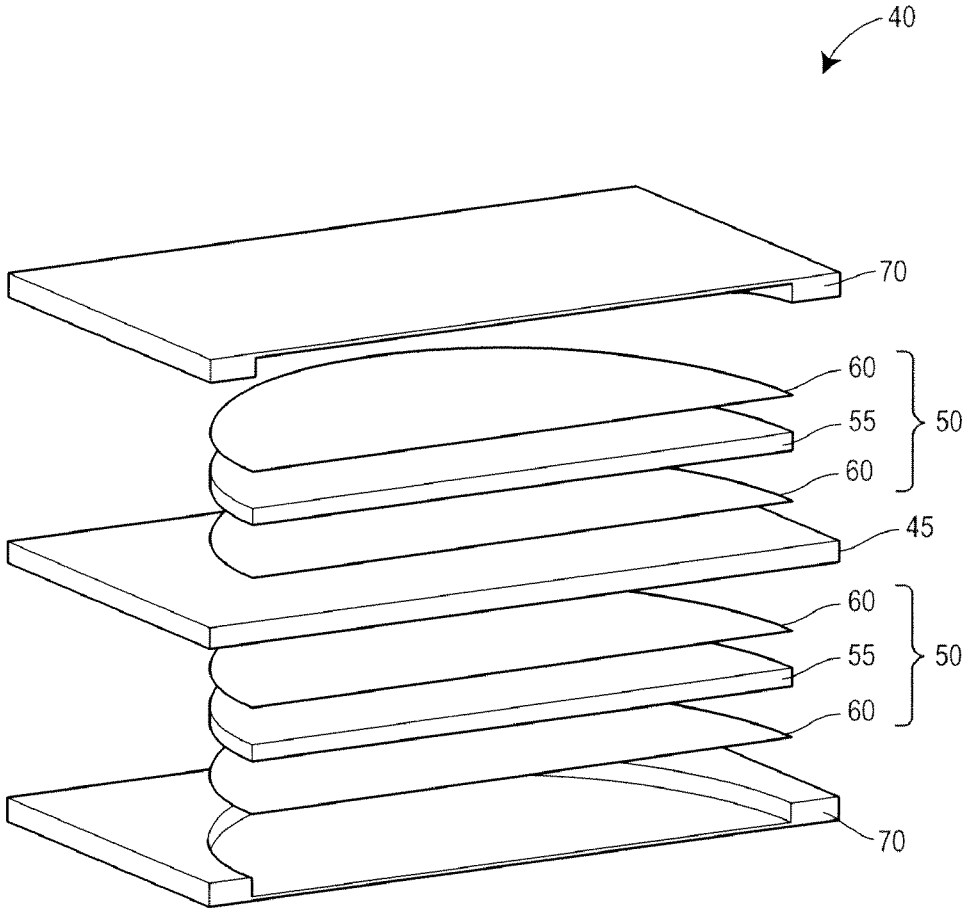
FIG. 7 is an exploded view of the pump membrane of FIG. 5.

The composition of the pump membrane 40 in a preferred embodiment actuated by piezoelectricity is more clearly shown in FIGS. 5-7. A passive intermediate layer 45 is designed to provide structural support for the pump membrane 40. The material chosen for the intermediate layer 45 should be stiff enough to support the stresses applied by the fluid being cycled through the micropump 10 while permitting repeated piezoelectric driven deformation. The material for intermediate layer 45 should also be chosen so that the stiffness of the intermediate layer is similar to that of the piezoelectric material to ensure a homogenous stress distribution over the intermediate layer 45 when the piezoelectric material is deformed. Intermediate layer 45 is preferably composed of PYREX® 7740 material, but it should be understood that suitable replacements can be chosen.

The intermediate layer 45 is disposed between two piezoelectric discs 50. A piezoelectric disc 50 is formed by stratifying a layer of piezoelectric material 55 between two layers of conducting material 60. Piezoelectric material 55 is made with Piezo Material Lead Zirconate Titanate (PZT-5A), although other piezoelectric materials can be used. The conducting material 60 may be composed of an epoxy such as the commercially available EPO-TEK H31 epoxy. The epoxy serves as a glue and a conductor to transmit power to the piezoelectric discs 50. The piezoelectric discs 50 are secured to the surface of the intermediate layer 45, so that when a voltage is applied to the membrane 40, a moment is formed to cause the membrane 40 to deform.

The layered pump membrane 40 further includes a non-conducting cover 70 covering both faces of the membrane 40. The covers 70 are composed of an electrically insulating material such as silicone rubber. The cover 70 serves to insulate the piezoelectric discs 50 from the fluid being pumped as well as to create a gasket to seal the chambers 20 and 30 from fluid leakage and communication with each other.

The pump membrane 40 thus comprises piezoelectric, conducting and insulating materials. The choice of materials depends on considerations including the need for increased chemical resistance to the fluid being transported, and the adjustment of electrical resistance and physical properties such as elasticity of the pump membrane. Ideally, the chosen materials are flexible in a range sufficient to permit piezoelectric activity to actuate the pump, are chemically inert to the fluid being transported and are physically resistant to stresses that would occur over the desired life cycle of the micropump.

The operation of the micropump 10 will now be described with reference to FIGS. 8*a*-8*c*. At rest, the upper chamber 20 and the lower chamber 30 are separated by a diaphragm pump membrane 40 as shown in FIG. 8*a*. A pair of diffuser elements 25 are in fluid communication with each chamber. Diffuser elements 25 are oriented so that the larger cross-sectional area end of one diffuser element is opposite the smaller cross-sectional area end of the diffuser element on the other side of the chamber. This permits a net pumping action across the chamber when the membrane is deformed.

The piezoelectric discs are attached to both the bottom and the top of the membrane. Piezoelectric deformation of the plates is varied by varying the applied voltage so as to excite the membrane with different frequency modes. Piezoelectric deformation of the cooperating plates puts the membrane into motion. Adjustments are made to the applied voltage and, if necessary, the choice of piezoelectric material, so as to optimize the rate of membrane actuation as well as the flow rate. Application of an electrical voltage induces a mechanical stress within the piezoelectric material in the pump membrane 40 in a known manner. The deformation of the pump membrane 40 changes the internal volume of upper chamber 20 and lower chamber 30 as shown in FIG. 8*b*. As the volume of the upper chamber 20 decreases, pressure increases in the upper chamber 20 relative to the rest state. During this contraction mode, the overpressure in the chamber causes fluid to flow out the upper chamber 20 through diffuser elements 25 on both sides of the chamber. However, owing to the geometry of the tapered diffuser elements, specifically the smaller cross-sectional area in the chamber end of the left diffuser element relative to the larger cross-sectional area of the right diffuser element, fluid flow out of the left diffuser element is greater than the fluid flow out the right diffuser element. This disparity results in a net pumping of fluid flowing out of the chamber to the left.

At the same time, the volume of the lower chamber 30 increases with the deformation of the pump member 40, resulting in an underpressure in the lower chamber 30 relative to the rest state. During this expansion mode, fluid enters the lower chamber 30 from both the left and the right diffuser elements 25. Again owing to the relative cross-sectional geometry of the tapered diffuser elements, fluid flow into the lower chamber 30 through the right diffuser element is greater than the fluid drawn into the lower chamber 30 through the left diffuser element. This results in a net fluid flow through the right diffuser element into the chamber, priming the chamber for the pump cycle.

Deflection of the membrane 40 in the opposite direction produces the opposite response for each chamber. As shown in FIG. 8*c*, the volume of the upper chamber 30 is increased. Now in expansion mode, fluid flows into the chamber from both the left and right sides, but the fluid flow from the right diffuser element is greater than the fluid flow from the left diffuser element. This results in a net intake of fluid from the right diffuser element, priming the upper chamber 30 for the pump cycle. Conversely, the lower chamber 30 is now in contraction mode, expelling a greater fluid flow from the lower chamber 30 through the left diffuser element than the right diffuser element. The result is a net fluid flow out of the lower chamber 30 to the left.

As can be seen from FIGS. 8*a*-8*c*, one frequency cycle of the membrane 40 causes the upper chamber 20 and the lower chamber 30 to alternately supply and pump fluid in the right to left direction. It will be readily apparent that the two chambers do not need to pump fluid in the same direction. The direction of fluid flow for one chamber can be reversed independently of the other chamber simply by reversing the configuration of the diffuser elements serving the particular chamber of interest.

Performance of the double superimposed chamber micropump is superior to a single chamber micropump. By optimizing geometric characteristics of the chamber and diffuser elements for the mechanical properties of the fluid to be pumped, net flow rates are significantly improved relative to a single chambered micropump with equivalent geometric dimensions in a low frequency field. Moreover, the double chambered micropump operates at a lower or equal membrane displacement and improves the maximum net flow frequency compared to a single chambered micropump.

Micropumps according to principles of the present invention may be operated at a substantially lower maximum flow working frequency. This results in savings in power consumption requirements and improves overall pump efficiency. Micropumps according to principles of the present invention can be constructed using well-known MEMS techniques and materials, providing a further economic advantage.

The present invention overcomes drawbacks associated with prior art miniaturized pumps. MEMS micropumps, such as those provided by the present invention, are one of the most promising devices for a new concept of medical care technologies. The present invention overcomes three main problems which compromise the potential wide diffusion of these types of products. By substantially improving efficiency of the micropump, the power source required may be miniaturized for use in portable applications. Further, the present invention, as mentioned, substantially reduces fabrication costs while improving inherent reliability of the micropump application.

Micropumps according to principles of the present invention provide a readily available technology for crucial applications, including life support and ongoing critical medical care. Micropumps according to principles of the present invention overcome real world problems, increasing pump efficiency despite fluid leakage losses (i.e. the micropumps exhibit improved volume metric efficiency), frictional losses (i.e. they exhibit improved mechanical efficiency) and losses due to imperfect pump construction (i.e. the micropumps exhibit improved hydraulic efficiency). Further, micropumps according to principles of the present invention can be employed to deliver a wide variety of materials in gaseous, liquid, or mixed phases. By avoiding the presence of movable parts such as check valves, inherent reliability, otherwise compromised by wear and fatigue, is substantially increased. Also, pressure loss and clogging of the working fluid, especially particle-ladened fluids, at one or more check valves is also avoided.

As mentioned, micropumps according to principles of the present invention are suitable for use in critical applications requiring equipment to be highly miniaturized. In one example, a micropump according to principles of the present invention, and of the type illustrated in the Figures, has a chamber side at length of 10 mm, and a chamber height equal to the nozzles/diffuser final width. The nozzles/diffusers have a length of 1.5 mm, an initial width of 150 μm and an opening angle of 5 degrees.

Compared to single chambered designs, micropumps according to principles of the present invention have a maximum flow working frequency that is about 30% lower than the single chambered design, with the same applied force on the membrane and the same geometry and materials. Further, micropumps according to principles of the present invention have a maximum flow rate that is 40% greater than that of comparable single chamber pumps. With the application of lower operating frequencies, micropumps according to principles of the present invention exhibit a 120% improvement in maximum flow rate.

It should be understood that while the operation of the preferred embodiments above has been described for actuating the pump through piezoelectric means, other actuation means such as thermopneumatic, electrostatic, pneumatic or other actuation means can be readily substituted.

While the various descriptions of the present invention are described above, it should be understood that various features can be used singly or in combination. Therefore, this invention is not to be limited to the specific preferred embodiments described herein. Further, it should be understood that variations and modifications within the spirit and scope of the invention may occur to those skilled in the art to which the invention pertains.

The invention claimed is:

1. A valveless micro-electro-mechanical micropump comprising:

a plurality of chambers having a side length of 10 mm or less;

a deformable pump membrane separating the plurality of chambers, the deformable pump membrane including an intermediate layer disposed between two piezoelectric discs, each piezoelectric disc including a layer of piezoelectric material disposed between two layers of conducting material, and a nonconducting cover covering a top and a bottom face of the deformable pump membrane; and an inlet diffuser element and an outlet diffuser element disposed in each of the plurality of chambers, the inlet and outlet diffuser elements providing a fluid connection between an interior of the chamber and an exterior of the chamber, each of the inlet and outlet diffuser elements including a chamber end opening proximate to the interior of the chamber and an exterior end opening connected by a fluid channel, the chamber end opening and the exterior end opening having different sized cross-sections, the fluid channel be tampered between the chamber end opening and the exterior end opening, wherein the fluid channel of the inlet diffuser element is largest at the chamber end opening and smallest at the exterior end opening and the fluid channel of the outlet diffuser element is smallest at the chamber end opening and largest at the exterior end opening.

2. The micropump of claim 1 wherein the pump membrane deforms as a result of a piezoelectric effect.

3. The micropump of claim 1 wherein the two piezoelectric discs are insulated.

4. The micropump of claim 1 wherein the diffuser elements are flat-walled and have a substantially rectangular cross-section.

5. The micropump of claim 4 wherein the diffuser elements are frusto-pyramidal.

6. The micropump of claim 1 wherein the plurality of chambers compromise two chambers.

7. The micropump of claim 6 wherein the two chambers are arranged to form a double superimposed chamber.

8. The micropump of claim 6, wherein the inlet diffuser elements and the outlet diffuser elements have a length of 1.5 mm, an initial width of 150 micrometers, and an opening angle of 5 degrees, and the chambers have a height equal to a final width of the inlet and outlet diffuser elements.

9. The micropump of claim 6, wherein the two chambers comprise a first chamber and a second chamber, wherein the first chamber inlet diffuser element and outlet diffuser element are arranged to pump fluid in a first direction that is substantially parallel to the deformable pump membrane when the deformable pump membrane is in an unactuated state and the second chamber inlet diffuser element and outlet diffuser element are arranged to pump fluid in a second direction that is substantially parallel to the deformable pump membrane, the second direction being opposite to the first direction.

10. The micropump of claim 1, wherein the two layers of conducting material comprise an epoxy.

11. The micropump of claim 10, wherein the epoxy is a single component, silver filled, electrically conductive epoxy.

12. The micropump of claim 1, wherein the intermediate layer comprises an inert material.

13. The micropump of claim 12, wherein the inert material is a low expansion borosilicate glass.

14. A valveless-micro-electro-mechanical micropump comprising:

an enclosure defining an interior chamber separated into an upper chamber and a lower chamber by a piezoelectrically responsive membrane, the enclosure having a side length of 10 mm or less, the piezoelectrically responsive membrane including an intermediate layer disposed between two piezoelectric discs, each piezoelectric disc including a layer of piezoelectric material disposed between two layers of conducting material, and a non-conducting cover covering a top and a bottom face of the piezoelectric membrane;

the upper chamber and lower chamber each having an inlet opening and an outlet opening connected by a fluid channel for providing fluid communication between an exterior of the enclosure and the interior chamber;

the inlet opening further having a chamber end proximate to the interior chamber and an exterior end, a cross-section of the chamber end being larger than a cross-section of the exterior end, the inlet opening fluid channel being largest at the chamber end and smallest at the exterior end; and the outlet opening further having a chamber end proximate to the interior chamber and an exterior end, a cross-section of the exterior end being larger than a cross-section of the chamber end, the outlet opening fluid channel being largest at the exterior end and smallest at the chamber end;

wherein when the piezoelectrically responsive membrane is deflected, fluid is pumped through the inlet opening into the interior chamber and out the outlet opening.

15. The micropump of claim 14 wherein a stiffness of the intermediate layer is similar to a stiffness of the piezoelectric material.

16. The micropump of claim 14 wherein the nonconducting covers comprise silicon rubber.

17. The micropump of claim 14 wherein the inlet openings and the outlet openings are frusto-conical.

18. The micropump of claim 14 wherein the inlet openings and the outlet openings are frusto-pyramidal.

19. The micropump of claim 14 wherein the upper and the lower chambers are arranged to form a double superimposed chamber.

* * * * *

UNITED STATES PATENT AND TRADEMARK OFFICE

CERTIFICATE OF CORRECTION

PATENT NO. : 8,308,452 B2
APPLICATION NO. : 11/991765
DATED : November 13, 2012
INVENTOR(S) : Amirouche et al.

It is certified that error appears in the above-identified patent and that said Letters Patent is hereby corrected as shown below:

In the Claims

Column 9, Line 4, in Claim 1, delete "channel be tampered" and insert -- channel being tapered --, therefor.

Column 9, Line 22, in Claim 6, delete "compromise two" and insert -- comprise two --, therefor.

Signed and Sealed this
Twenty-first Day of October, 2014

Michelle K. Lee

Michelle K. Lee
*Deputy Director of the United States Patent and Trademark Office*